US009174778B2

(12) United States Patent
Toh et al.

(10) Patent No.: US 9,174,778 B2
(45) Date of Patent: Nov. 3, 2015

(54) PACKAGING FOR A CONSUMER PRODUCT

(75) Inventors: Kiat-Cheong Toh, Forest Hills, NY (US); Jonas Damon, New York, NY (US); Daniel Antonio Pacis-Sanchez, Brooklyn, NY (US); Allison Stacey Conner, Brooklyn, NY (US)

(73) Assignee: COLGATE-PALMOLIVE COMPANY, New York, NY (US)

( * ) Notice: Subject to any disclaimer, the term of this patent is extended or adjusted under 35 U.S.C. 154(b) by 448 days.

(21) Appl. No.: 13/811,046

(22) PCT Filed: Jul. 22, 2010

(86) PCT No.: PCT/US2010/042894

§ 371 (c)(1),
(2), (4) Date: Jan. 18, 2013

(87) PCT Pub. No.: WO2012/011911

PCT Pub. Date: Jan. 26, 2012

(65) Prior Publication Data

US 2013/0119059 A1 May 16, 2013

(51) Int. Cl.

| | |
|---|---|
| ***B65D 47/32*** | (2006.01) |
| ***A45D 34/04*** | (2006.01) |
| ***B65D 51/16*** | (2006.01) |
| ***B65D 51/24*** | (2006.01) |
| ***B65B 7/28*** | (2006.01) |

(52) U.S. Cl.

CPC ..... *B65D 47/32* (2013.01); *A45D 34/041* (2013.01); *B65B 7/28* (2013.01); *B65D 51/1672* (2013.01); *B65D 51/245* (2013.01); *B65D 2203/12* (2013.01)

(58) Field of Classification Search

CPC combination set(s) only.
See application file for complete search history.

(56) References Cited

U.S. PATENT DOCUMENTS

| | | | | |
|---|---|---|---|---|
| 2,219,604 | A | 10/1940 | Trotter | |
| 2,600,978 | A | 4/1943 | DeMarco, Jr. | |
| 2,316,516 | A | 6/1952 | Hammerstein | |
| 4,487,326 | A * | 12/1984 | Uhlig | 215/307 |
| 4,858,831 | A * | 8/1989 | Spector | 239/326 |
| 5,110,017 | A | 5/1992 | Braun | |
| 5,265,771 | A | 11/1993 | Meshberg | |
| 5,265,775 | A * | 11/1993 | Sinclair et al. | 222/400.8 |
| 5,567,073 | A | 10/1996 | de Laforcade et al. | |
| 5,688,544 | A * | 11/1997 | Bolton et al. | 426/118 |
| 5,836,484 | A | 11/1998 | Gerber | |
| 5,842,806 | A | 12/1998 | Rettke | |

(Continued)

FOREIGN PATENT DOCUMENTS

| | | |
|---|---|---|
| DE | 102006006771 | 4/2007 |
| DE | 102006050652 | 4/2008 |

(Continued)

OTHER PUBLICATIONS

International Search Report and Written Opinion for International Application No. PCT/US2010/042894 mailed Feb. 11, 2011.

*Primary Examiner* — David Walczak

(57) ABSTRACT

A consumer product comprises a container for packaging a composition having a scent. A removable cap is fitted to the container, with the cap and the container defining a cavity therebetween. The cap has an orifice, for communicating between the cavity and an exterior of the cap, and a manually deformable part which is adapted to be displaceable thereby to displace air from an internal location within the cavity outwardly through the orifice.

25 Claims, 2 Drawing Sheets

(56) References Cited

U.S. PATENT DOCUMENTS

| | | | | |
|---|---|---|---|---|
| 5,891,380 | A | 4/1999 | Larue et al. | |
| 6,179,505 | B1 | 1/2001 | Oder, III et al. | |
| 6,202,901 | B1 | 3/2001 | Gerber et al. | |
| 6,290,103 | B1 | 9/2001 | Fraillon | |
| 6,325,253 | B1 | 12/2001 | Robinson | |
| 6,443,373 | B1 | 9/2002 | Portugues | |
| 6,547,471 | B1 | 4/2003 | Tucker et al. | |
| 6,736,335 | B2 * | 5/2004 | Cuthbert | 239/327 |
| 6,814,520 | B1 | 11/2004 | Delli Venneri et al. | |
| 6,866,164 | B2 | 3/2005 | Branson et al. | |
| 6,896,151 | B1 | 5/2005 | Robinson | |
| 7,117,818 | B2 | 10/2006 | Pappas et al. | |
| 7,344,328 | B2 | 3/2008 | McAvley | |
| 7,416,358 | B2 | 8/2008 | Legendre | |
| 7,513,396 | B2 | 4/2009 | Pardes et al. | |
| 2001/0050264 | A1 | 12/2001 | Schorner | |
| 2002/0067949 | A1 | 6/2002 | Melnik et al. | |
| 2004/0083826 | A1 | 5/2004 | Botha et al. | |
| 2005/0276653 | A1 | 12/2005 | Thiebaut | |
| 2006/0249592 | A1 | 11/2006 | Burrowes et al. | |
| 2007/0090110 | A1 | 4/2007 | Skelton et al. | |
| 2007/0114142 | A1 | 5/2007 | Sine et al. | |

FOREIGN PATENT DOCUMENTS

| | | |
|---|---|---|
| EP | 0251939 | 1/1988 |
| EP | 1136015 | 9/2001 |
| TW | 292517 | 12/1996 |
| TW | 564710 | 12/2003 |
| WO | WO 2007/062374 | 5/2007 |
| WO | WO 2007/110596 | 10/2007 |
| WO | WO 2007/0110596 | 10/2007 |
| WO | WO 2009/0056819 | 5/2009 |
| WO | WO 2009/0102917 | 8/2009 |

* cited by examiner

PACKAGING FOR A CONSUMER PRODUCT

CROSS-REFERENCE OF RELATED APPLICATIONS

This application is a U.S. national stage entry under 35 U.S.C. §371 of Patent Cooperation Treaty Patent Application No. PCT/US2010/042894, filed Jul. 22, 2010, the entirety of which is incorporated herein by reference.

BACKGROUND

The present invention relates to a packaging for a consumer product.

Many consumer products are scented. Often, a consumer wishes to sample the scent before purchasing the product in a store. When the product is a product such as an anti-perspirant or deodorant composition winch is sold in a roll-on or stick format, there is a problem that a user may remove the cap protecting the roll-ball or stick to try to sample the scent of the composition within the container. Other consumer products, such as liquid soap and detergents may have a seal that would have to be removed in order to sample the scent.

Historically, shoppers of roll-on products tend to remove the cap to smell the packaged product, often spinning the ball with their finger in order to wet the finger with the product, and then replace the cap. Shoppers of stick products also tend to open the cap to smell the packaged product, often causing the dome, or factory finish, which temporarily protects the underlying stick and allows for filling during manufacture, to fall out. The dome is sometimes referred to as the "factory finish" by those skilled in the art. The primary purpose of the dome is to allow filling of the container with the product when the container is in an inverted position, a secondary purpose being to protect the stick prior to use. Replacing the dome and/or touching the product compromises the presentation of the package and renders it potentially unsealable.

Similarly, shoppers of other consumer products may also compromise package presentation. In consumer products like liquid soap or detergent, the shopper may remove a seal to smell the product. If the shopper decides to purchase the product, they often pick an untampered package, but replace the product which they sampled back onto the shelf, which can cause the now compromised product to be damaged and be potentially unsealable.

SUMMARY

The present invention aims to provide a consumer product which is packaged to allow shoppers to sample the scent of the product without opening the package or compromising the package's factory-fresh presentation.

The cap is typically located at the top of the container, but alternatively the cap may be located at the bottom of the container, for example on a secondary cap which seals the bottom of the container after a filling step in which the container is inverted. Typically, the manually deformable pan comprises a flexible membrane. In a preferred embodiment, in which the cap is located at the top of the container, the manually deformable part is disposed at an upper surface of the cap. Optionally, the manually deformable part comprises a majority of the upper surface of the cap. Correspondingly, in an alternative embodiment, in which the cap is located at the bottom of the container, the manually deformable part is disposed at a lower surface of the cap, and for example comprises a majority of the lower surface of the cap The manually deformable part may be composed of a thermoplastic elastomer. Typically, the orifice is composed of an elastic material which maintains the orifice in a substantially closed condition in the absence of a pressure differential across the orifice. The orifice may be provided in a thermoplastic elastomer. In one embodiment, the manually deformable part and the orifice are provided in a common body of thermoplastic elastomer. Optionally, the manually deformable part has an external surface shaped with a recess for receiving a finger of a user.

The present invention accordingly provides a consumer product comprising a container for containing a scented composition and a cap fitted to the container, the cap and the container defining a cavity therebetween, the cap having an orifice, for communicating between the cavity and an exterior of the cap, and a manually deformable part which is adapted to be displaceable thereby to displace air from an internal location within the cavity outwardly through the orifice.

Typically, the manually deformable part comprises a flexible membrane. In a preferred embodiment, the manually deformable part is disposed at an upper surface of the cap. Optionally, the manually deformable pan comprises a majority of the upper surface of the cap. The manually deformable part may be composed of a thermoplastic elastomer. Typically, the orifice is composed of an elastic material which maintains the orifice in a substantially closed condition in the absence of a pressure differential across the orifice. The orifice may be provided in a thermoplastic elastomer. In one embodiment, the manually deformable part and the orifice are provided in a common body of thermoplastic elastomer. In another embodiment, the manually deformable part and the orifice are provided in a common body of injection moldable or blow moldable resin, for example polypropylene. Optionally, the manually deformable pan has an external surface shaped with a recess for receiving a finger of a user.

The consumer product may further comprise a tamper evident element connecting together the container and the cap.

In some embodiments, the container is a roll-ball container containing a liquid composition. In other embodiments, the container contains a solid stick of the composition. Typically, the composition is an anti-perspirant or deodorant composition.

The present invention also provides a packaged consumer product comprising a container containing a scented personal care composition, selected from a liquid and a solid personal care composition, and a scent sampler for displacing air which contains the scent from an internal location within the package to outside the package without opening the package.

Typically, the scent sampler comprises a manually deformable part and an orifice, the manually deformable part being adapted to be displaceable thereby to displace air from the internal location outwardly through the orifice. The packaged consumer product may further comprise a tamper evident element sealing the package. In one embodiment, the container is a roll-ball container containing a liquid antiperspirant or deodorant composition. In another embodiment, the container contains a stick of a solid anti-perspirant or deodorant composition. In a further embodiment, the container contains a soap or body wash composition. In a yet further embodiment, the container contains a detergent or fabric softener.

The present invention further provides a method of packaging a consumer product, the method comprising the steps of:

(a) disposing a scented composition in a container, the composition being selected from a liquid and a solid composition;

(b) applying a cap to the container to seal the container, the cap including a manually actuatable scent sampler for displacing air located between the cap and the container to outside the package without opening the package; and (c) permitting scent from the composition to become infused in the air located between the cap and the container.

The present invention yet further provides a method of sampling the scent of a consumer product, the method comprising the steps of:

(a) providing a packaged consumer product comprising a container for containing a scented composition, selected from a liquid and a solid composition; and (b) displacing air which contains the scent from an internal location within the package to outside the package without opening the package.

Accordingly, the embodiments of the invention can provide that the scent of the packaged composition can be sampled by a prospective purchaser by sampling the scent of the actual packaged product but without opening the package, exposing the packaged product, or compromising the integrity of the packaging or the packaged consumer product.

DETAILED DESCRIPTION OF THE PREFERRED EMBODIMENTS

Figure 1:
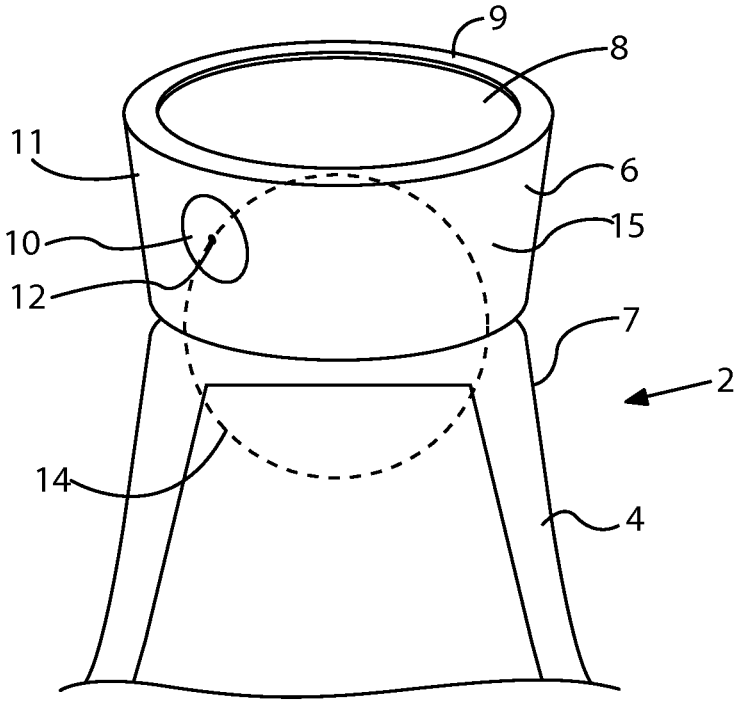
FIG. 1 is a schematic perspective view of an upper portion of a roll-on container for a personal care product such as an antiperspirant or deodorant composition in accordance with a first embodiment of the present invention.

Referring to FIG. 1, there is shown a schematic perspective view of an upper portion of a roll-on container 2 in accordance with a first embodiment of the present invention.

The container 2 includes a body portion 4 and a cap 6 which is removably mounted thereon, for example by conventional helical threads (not shown). The body portion 4 packages a consumer product such as an antiperspirant or deodorant composition. The cap 6 covers and protects a roll-ball 14 (shown in phantom in FIG. 1) which is mounted in conventional manner at an end 7 of the body portion 4. The cap 6 includes a flexible portion 8, in the form of a membrane, which can be manually depressed by a user. Typically, the flexible portion 8 is located in an upper wall 9 of the cap 6 and takes up the major proportion of the upper surface of the cap 6. A surrounding skirt 11 of the cap 6 depends downwardly from the upper wall 9 and is threadably fitted to the end 7 of the body portion 4. A flexible insert 10 defining an outlet orifice 12 is located in the skirt 11. The outlet orifice 12 is typically maintained in a substantially closed condition by the elastic properties of the flexible insert 10 in the absence of a pressure differential across the outlet orifice 12. Therefore, when the packaged container is not being handled manually to sample the scent as described below, the cap is substantially sealed. The cap 6 defines a closed cavity 15 above the roll-ball 14 which is infused with scent from the consumer product packaged within the container 2.

The cap 6 on the one hand, and the flexible portion 8 and insert 10 an the other hand, may be composed of a two plastic materials, and are typically bi-injection molded, with the flexible portion 8 and the insert 10 being composed of a relatively flexible material, such as a thermoplastic elastomer, and the upper wall 9 and the skirt 11 being composed of a relatively rigid material, such as polypropylene. The flexible portion 8 and the insert 10 may be separated, as shown, or connected together. Alternatively, the cap 6, flexible portion 6 and insert 10 may be composed of a single plastic material, with the flexible portion 8 having a thinner wall thickness as compared to the upper wall 9 and skirt 11 to provide the required flexibility for the flexible portion 8 and an orifice 12 sufficiently small in cross-section or sealed so that the scent is retained within the cavity 15 prior to sampling, as described below. Optionally, a flexible hinge (not shown may be provided between the flexible portion 8 and the upper wall 9.

Figure 2:
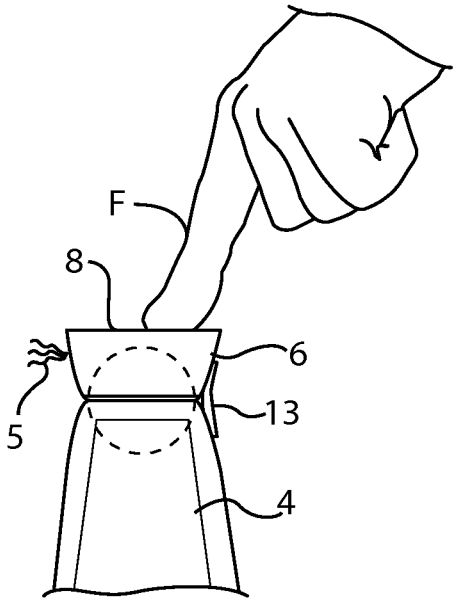
FIG. 2 is a schematic side view of the roll-on container of FIG. 1 when used to provide a scent preview to a user.

As shown in FIG. 2, when a shopper wishes to sample the scent of the consumer product packaged within the container 2, the shopper can manually depress the flexible portion 8 with their finger F. This causes the flexible portion 8 to be flexed inwardly, thereby reducing the volume of the closed cavity 15, which in turn causes a corresponding volume of the scent-infused air within the closed cavity 15 to be displaced outwardly through the orifice 12, to form a scent-release S from the cavity 15. The pressure differential across the orifice 12 causes the flexible insert 10 to deform thereby temporarily to open up the orifice 12 to permit the scent release. The scent can then be sampled by the shopper. The scent can be sampled without removing the cap 6 of the packaged product, and so the package is not opened to sample the scent. Moreover, the scent of the packaged product itself may be sampled, and not the scent of a separately provided sample which may differ perceptibly from the actual packaged product.

After the manual pressure is released, the flexible portion 8 and the insert 10, which are resilient or elastic, return to their initial configuration. This permits the scent of the product to be sampled again by a subsequent shopper.

In order to direct the shopper to the scent sampling feature, the product may be labeled with printed information to highlight the scent sampling flexible portion 8 to the customer. Furthermore, the container 2 may be provided with a tamper evident feature to discourage a shopper from removing the cap 6 in store to test the product. Such a tamper evident feature may be selected from, for example, a shrink band, an extended shrink label, a pressure sensitive and/or geometry molded into the packaging components, i.e. the body portion 4 and the cap 6, to achieve the goal of keeping the package uncompromised prior to the sale of the product to a customer. FIG. 2 illustrates a tamper evident feature in the form of a pressure sensitive label 13 bridging the body portion 4 and the cap 6. The provision of such a tamper evident feature would inhibit the consumers' typical behavior of unscrewing the cap 6 at the point of sale. In fact, hindering the opening of the cap 6 would prompt the user to take a closer look at the product and notice the scent preview feature of the present invention.

Accordingly, the consumer product is packaged to allow shoppers to sample the scent of the product without compromising the package's factory-fresh presentation.

Figure 3:
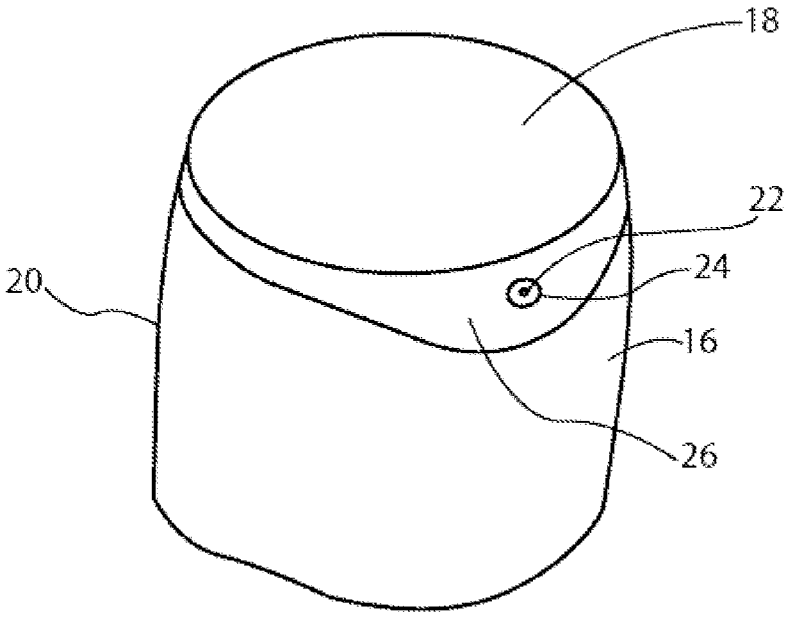
FIG. 3 is a schematic perspective view of a cap for a container for a consumer product in accordance with a second embodiment of the present invention.

Referring to FIG. 3, there is shown a schematic perspective view of a cap 16 for a consumer product container in accordance with a second embodiment of the present invention.

The cap 16 is adapted for removable snap- or push-fitting over a container (not shown) for a personal care product or consumer product such as an anti-perspirant, for example a roll-on anti-perspirant, or deodorant, for example a deodorant stick. The cap 16 covers and protects the roll-ball and the free end of the container. The cap 16 includes a relatively flexible substantially planar top wall 18 mounted on a relatively rigid skirt 20 which is shaped and dimensioned to fit onto the container. The cap 16 could also contain threads for threaded coupling with the container for a consumer product such as a body wash, liquid soap, fabric softener, detergent and the like. The top wall 18 is typically composed of a thermoplastic elastomer and the skirt 20 is typically composed of polypropylene. The top wall 18 includes an orifice 22 extending therethrough which is surrounded by an annular depression 24 constituted by a thinning of the material of the top wall 18. As illustrated in FIG. 3, the orifice 22 is located on an annular side surface 26 of the top wall 18 above the skirt 20.

As for the embodiment of FIGS. 1 and 2, manual pressure acting on the top wall 18 can flex the top wall, thereby to reduce the volume of the closed cavity between the cap 6 and the container, which in turn causes a corresponding volume of the scent-infused air within the closed cavity to be displaced through the orifice 12, to form a scent-release from the cavity.

Figure 4:
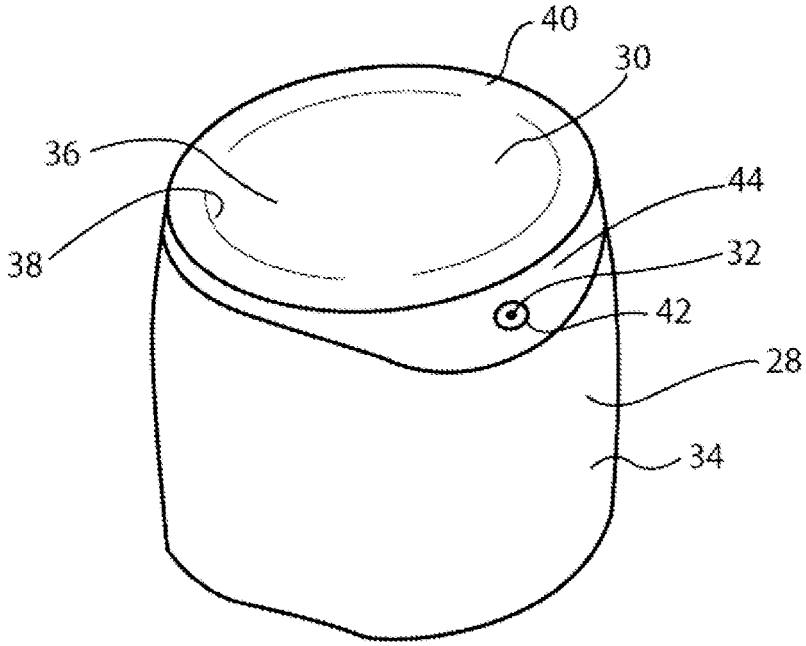
FIG. 4 is a schematic perspective view of a cap for a container for a consumer product in accordance with a third embodiment of the present invention.

FIG. 4 shows a schematic perspective view of a cap 28 for a consumer product container in accordance with a third embodiment of the present invention, which is a modification of the cap of the second embodiment shown in FIG. 3.

The cap 28 is, again, adapted for removable snap-fitting over a container (not shown) for a consumer product such as an anti-perspirant or deodorant stick, body wash, liquid soap, detergent, fabric softener and the like. The cap 28 could alternatively comprise threads for mating with threads on a neck of a container (not shown). The cap 28 includes a relatively flexible top wall 30 mounted on a relatively rigid skirt 34 which is shaped and dimensioned to fit onto a container. The top wall 30 includes a central depression or recess 36 surrounded by an annular upwardly inclined surface 38 terminating in an annular ridge 40 around the cap 28. The top wall 30 is typically composed of a thermoplastic elastomer and the skirt 34 is typically composed of polypropylene. The top wall 30 includes an orifice 32 extending therethrough which is surrounded by an annular depression 42 constituted by a thinning of the material of the top wall 30. As illustrated in FIG. 4, the orifice 32 is located on an annular side surface 44 of the top wall 30 above the skirt 34.

The shaping of the top will 30 to include the central depression 36 provides the user with an easy to use structure for finger location above the flexible membrane for sampling the scent of the personal care product within the container.

The caps of the previous embodiments may readily be modified so as to be suitable for removable snap-fitting over a container (not shown) for a personal care product such as an anti-perspirant or deodorant in the form of a stick. For example, the shape of the cap may be modified so as to have a cross-section corresponding to that of the packaged stick, for example an oval cross-section, with correspondingly modified dimensions. The cap accordingly covers and protects the free end of a stick.

In another modification, when the container is for a stick product, the cap may be a secondary cap located at the bottom of the container, the cap sealing the bottom of the container after filling thereof with the stick composition. In such a modification, the manually deformable part may be disposed at a lower surface of the cap, and for example comprises a majority of the lower surface of the cap. Other features described earlier for the structure of the cap, when located at the top of the container, may be incorporated into such a secondary lower cap.

In a modification of any of the embodiments described, the deformable part and the orifice may be provided in a common body of injection-molded or blow-molded resin, for example polypropylene.

Other modifications to and embodiments of the present invention will be apparent to those skilled in the art.

What is claimed is:

1. A consumer product comprising a container for containing a scented composition to be dispensed from the container during use by a user, and a cap fitted to the container, the cap and the container defining a cavity therebetween, the cap having an orifice, for communicating between the cavity and an exterior of the cap, and the cap further having a manually deformable part which is adapted to be displaceable thereby to displace air that is scented by the scented composition to be dispensed from the container during use by a user from an internal location within the cavity outwardly through the orifice.

2. A consumer product according to claim 1 wherein the manually deformable part comprises a flexible membrane.

3. A consumer product according to claim 1 wherein the manually deformable part is disposed at an upper surface of the cap.

4. A consumer product according to claim 3 wherein the manually deformable part comprises a majority of the upper surface of the cap.

5. A consumer product according to claim 1 wherein the manually deformable part is composed of a thermoplastic elastomer.

6. A consumer product according to claim 5 wherein the manually deformable part and the orifice are provided in a common body of thermoplastic elastomer.

7. A consumer product according to claim 1 wherein the orifice is composed of an elastic material which maintains the orifice in a substantially closed condition in the absence of a pressure differential across the orifice.

8. A consumer product according to claim 7 wherein the orifice is provided in a thermoplastic elastomer.

9. A consumer product according to claim 1 wherein the manually deformable part has an external surface shaped with a recess for receiving a finger of a user.

10. A consumer product according to claim 1 further comprising a tamper evident element connecting together the container and the cap.

11. A consumer product according to claim 1 wherein the container is a roll-ball container containing a liquid composition.

12. A consumer product according to claim 1, further comprising a solid stick of a scented composition, wherein the solid stick of the scented composition is positioned within the container.

13. A consumer product according to claim 12 wherein the cap is located at a bottom of the container.

14. A consumer product according to claim 1, further comprising an anti-perspirant or deodorant composition positioned within the container.

15. A consumer product according to claim 14 wherein the cap is a secondary cap which seals the bottom of the container.

16. A package for a consumer care product, comprising:

a container for containing a scented consumer care composition;

a scented consumer care composition to be dispensed from the container during use by a user and positioned within the container, wherein the scented consumer care composition has a scent and the scented consumer care composition is selected from a liquid composition and a solid composition;

air within the package, wherein the air is scented by the scented consumer care composition; and a scent sampler for displacing the air which contains the scent from an internal location within the package to a location outside the package without opening the package.

17. A package according to claim 16 wherein the scented consumer care composition comprises a stick of a solid anti-perspirant or deodorant.

18. A package according to claim 16 wherein the scent sampler comprises a manually deformable part and an orifice, the manually deformable part being adapted to be displaceable thereby to displace air from the internal location outwardly through the orifice.

19. A package for a consumer product comprising a container containing a scented composition having a scent, the scented composition to be dispensed from the package during use by a user and being selected from a liquid and a solid composition, and a scent sampler for displacing air which contains the scent from the scented composition from an internal location within the package to outside the package without opening the package while an entirety of the scented composition, except for the scent within the scented air, remains within the container.

20. A package according to claim 19 wherein the scent sampler comprises a manually deformable part and an orifice, the manually deformable part being adapted to be displaceable inwardly thereby to displace air from the internal location outwardly through the orifice.

21. A package according to claim 19 further comprising a tamper evident element sealing the package.

22. A package according to claim 19 wherein the container is a roll-ball container for containing a scented composition.

23. A package according to claim 19 wherein the container contains a stick of a solid anti-perspirant or deodorant composition.

24. A method of packaging a consumer product within a package, the method comprising:

disposing a composition in a container, the composition being, selected from a liquid personal care composition and a solid personal care composition;

applying a cap to the container to seal the container, the cap including a manually actuatable scent sampler for displacing scented air located between the cap and the container to outside the package without opening the package;

permitting a scent from the composition to become infused in the air located between the cap and the container; and forming the package so as to allow the scented air to be displaced from the container while an entirety of the composition, except for the scent within the air, remains within the container.

25. A method of sampling the scent of a consumer product, the method comprising:

providing a package comprising a container, scented air positioned within the container, and a scented composition positioned within the container, wherein the scented composition has a scent, the scented air contains the scent from the scented composition, and the scented composition is selected from a liquid composition and a solid composition; and displacing the scented air which contains the scent from an internal location within the package to outside the package without opening the package while an entirety of the scented composition, except for the scent within the scented air, remains within the container.

* * * * *